US006470523B1

(12) United States Patent
Sardonico

(10) Patent No.: US 6,470,523 B1
(45) Date of Patent: Oct. 29, 2002

(54) FOLDAWAY RAMP FOR DISABLED PEOPLE IN WHEELCHAIRS AND CHILDREN'S PUSHCHAIRS FOR LOW FLOOR VEHICLES

(75) Inventor: Gennaro Sardonico, Turin (IT)

(73) Assignee: Rollon S.p.A., Milan (IT)

( * ) Notice: Subject to any disclaimer, the term of this patent is extended or adjusted under 35 U.S.C. 154(b) by 0 days.

(21) Appl. No.: 09/884,077

(22) Filed: Jun. 20, 2001

(30) Foreign Application Priority Data

Jun. 21, 2000 (IT) ..... TO00A0607

(51) Int. Cl.[7] ..... A61G 3/06
(52) U.S. Cl. ..... 14/71.1; 14/69.5; 414/921
(58) Field of Search ..... 14/69.5, 71.1, 14/71.3, 71.5, 71.7; 414/546, 921, 537, 522, 523, 558

(56) References Cited

U.S. PATENT DOCUMENTS 4,339,224 A * 7/1982 Lamb ..... 414/501
4,827,548 A * 5/1989 Hood ..... 14/71.1
4,900,217 A * 2/1990 Nelson ..... 414/537
5,380,144 A * 1/1995 Smith et al. ..... 414/537
5,393,192 A * 2/1995 Hall et al. ..... 14/69.5
5,636,399 A * 6/1997 Tremblay et al. ..... 14/71.1
6,039,528 A * 3/2000 Cohn ..... 414/546

* cited by examiner

*Primary Examiner*—Thomas B. Will
*Assistant Examiner*—Alexandra K. Pechhold
(74) *Attorney, Agent, or Firm*—Sughrue Mion, PLLC

(57) ABSTRACT

Foldaway ramp for the access of disabled people's wheelchairs and children's pushchairs aboard vehicles with low floors, comprising a platform, displaceable between a retracted position and an extracted position, with respect to a supporting frame, provided underneath the floor. Cams are provided for controlling slant of the platform, during the final phase of its displacement towards the extracted position, from a position parallel to the floor to a position which is slanted downwards, where the front edge of the platform rests on the ground, and the return of the platform to the position in which it is parallel to the floor during the initial phase of its displacement towards the retracted position, by effect respectively of raising and lowering the rear side of the platform operated by the cams.

5 Claims, 6 Drawing Sheets

FOLDAWAY RAMP FOR DISABLED PEOPLE IN WHEELCHAIRS AND CHILDREN'S PUSHCHAIRS FOR LOW FLOOR VEHICLES

FIELD OF THE INVENTION

This invention relates in general to equipment for facilitating the access of disabled people's wheelchairs and children's pushchairs aboard vehicles, i.e. public transport vehicles, such as buses, trams or similar, with low floors.

Specifically, this invention relates to a ascent and descent ramp for overcoming a difference in level between the ground and the low floor of the vehicle where it is installed on a suitable gradient in accordance to standards.

SUMMARY OF THE INVENTION

The purpose of this invention is to make a ramp of this type, which can be fully folded away, i.e. which is included in the volume of the vehicle, and which, at the same time is relatively simple and cost-effective.

An additional purpose of this invention is to provide a ramp of the type described above, which minimises the number of actuators required to displace it, excluding, in all cases, the use of fluid actuators.

These purposes are obtained essentially thanks to the fact that the ramp according to this invention comprises:

- a supporting structure embedded within a housing provided under said vehicle floor,
- a platform displaceable between a retracted position and an extracted position, with respect to said supporting structure, parallelly to the vehicle floor,
- electric actuator control means for moving said platform between said retracted position and said extracted position and,
- cam means for controlling slant of said platform, during the final phase of its displacement towards the extracted position, from a position parallel to said floor to a position which is slanted downwards, where the front edge of the platform rests on the ground, and the return to said position in which it is parallel to the floor during the initial phase of its displacement towards said retracted position, by effect respectively of raising and lowering the rear side of said platform operated by said cam means.

Thanks to the idea implemented in this solution, the use of a motor unit and complicated mechanisms to rock the platform is avoided, with evident advantages in terms of construction simplicity and cost-effectiveness, as well as size containment.

According to a preferred form of embodiment of this invention, said cam means comprise:

- upwards slanted sliding surfaces arranged near the upper edge of said supporting structure, and
- complementary elements whose shape is complementary with respect to said sliding surfaces, articulated on the rear edge of said platform and co-operating with said sliding surfaces by sliding contact.

The sliding surfaces and the complementary elements conveniently have a rounded profile and are also equipped with reciprocal removable stop members between the rear edge of the platform and the front edge of the supporting structures in said downwards slanted position.

The platform can conveniently consists of a frame carrying continuous conveyor endless belt means for facilitating the ascent of the wheelchair or pushchair.

BRIEF DESCRIPTION OF THE DRAWINGS

The invention will be better explained by the following detailed descriptions with reference to the accompanying figure as non-limiting example, wherein.

DETAILED DESCRIPTION OF THE INVENTION

Figure 1:
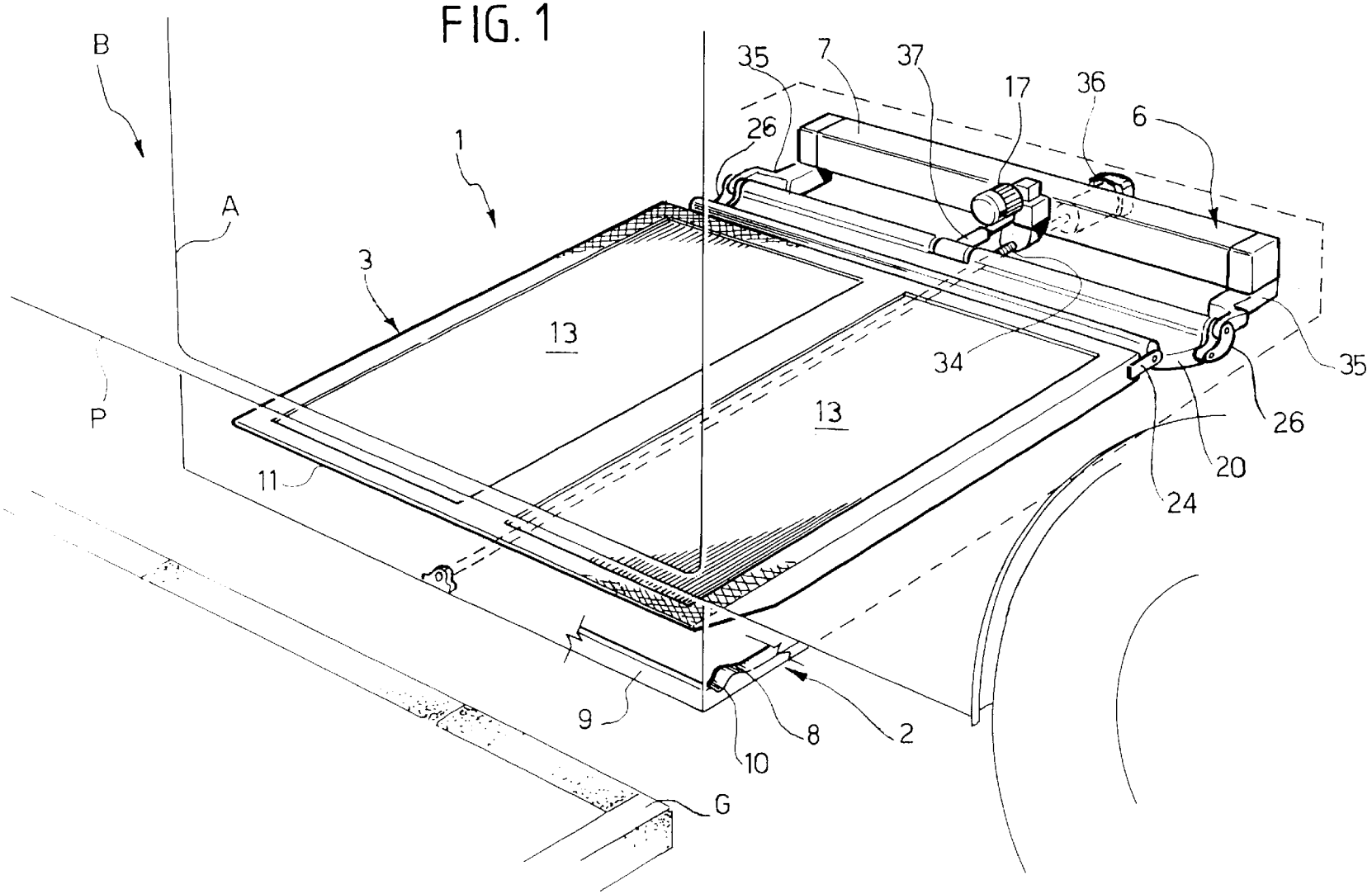
FIG. 1 is a perspective, schematic simplified view showing the ramp according to this invention in the retracted condition with reference to the low floor of a bus.

In the drawings, B schematically indicates the area of a bus, or similar public transport vehicles, with a low floor P, accessible through a door A. To allow comfortable, easy passage from the ground G to the low floor P, and vice-versa, this invention envisages a ramp, generally indicated with numeral 1, including a supporting structure, generally indicated with numeral 2, and a platform 3, displaceable with reference to the supporting structure 2, between a retracted resting position, illustrated in FIG. 1, and an extracted, slanted working position, illustrated in FIG. 2.

Figure 2:
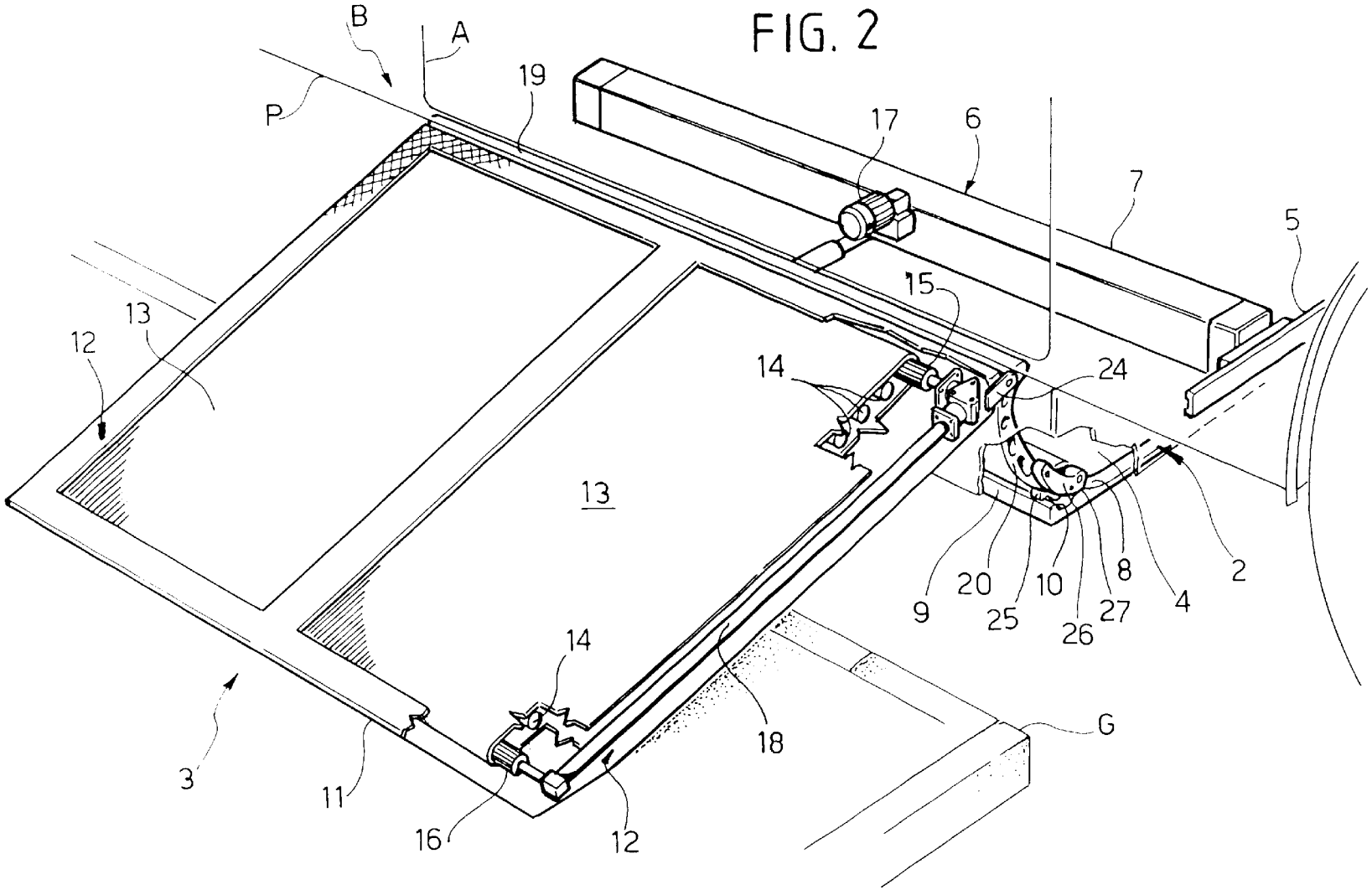
FIG. 2 is a similar view to FIG. 1, partially cut, showing the ramp in the extracted position in which it is slanted downwards.

The supporting structure 1 consists of a frame embedded in a lateral recess H provided under the floor P of the bus B and equipped with a pair of lateral guides 5, substantially C-shaped, only one of which is shown in FIG. 2.

Figure 7:
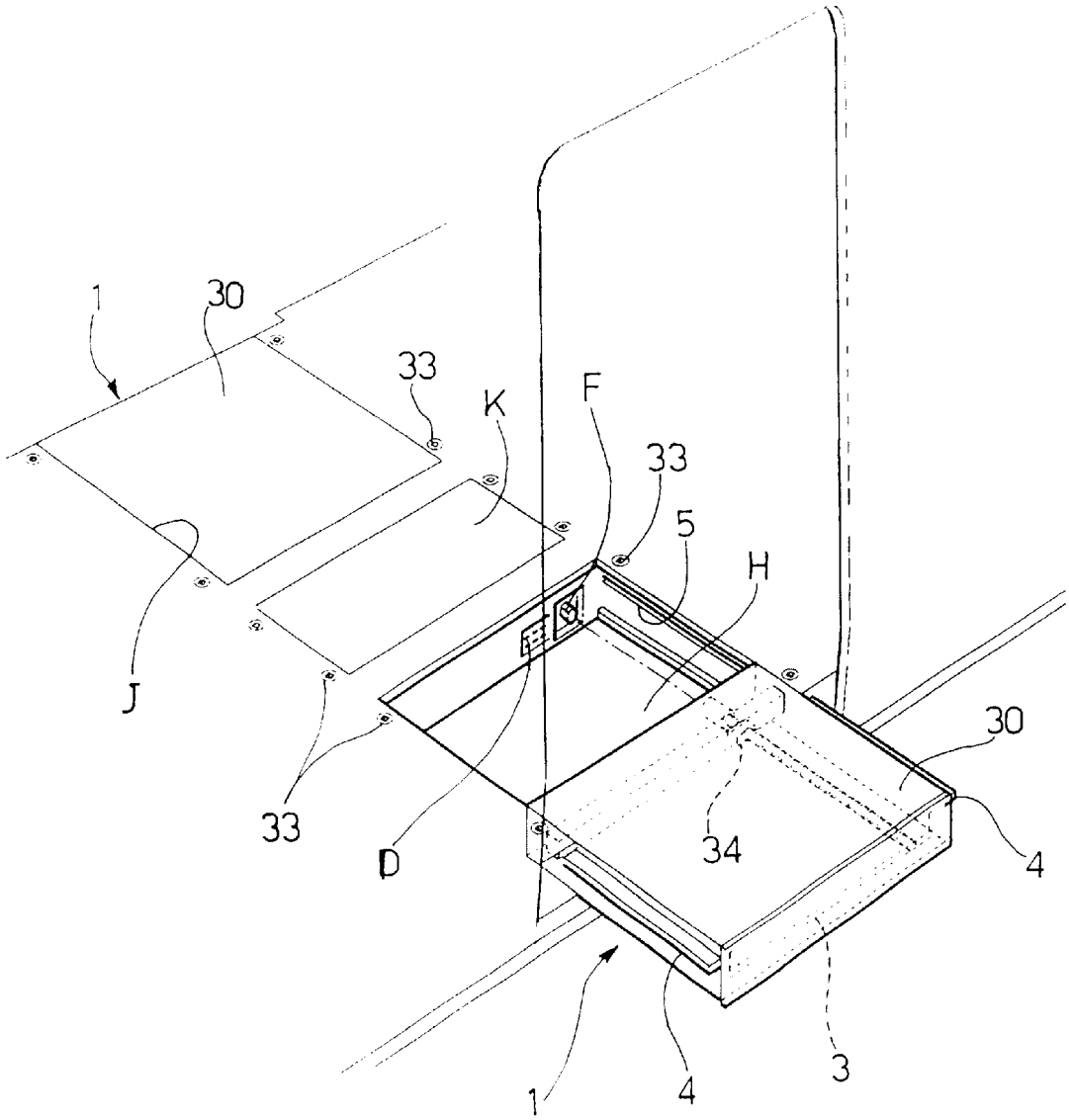
FIG. 7 shows diagrammatically, in perspective and in an enlarged scale, a variant of FIG. 1.
Figure 8:
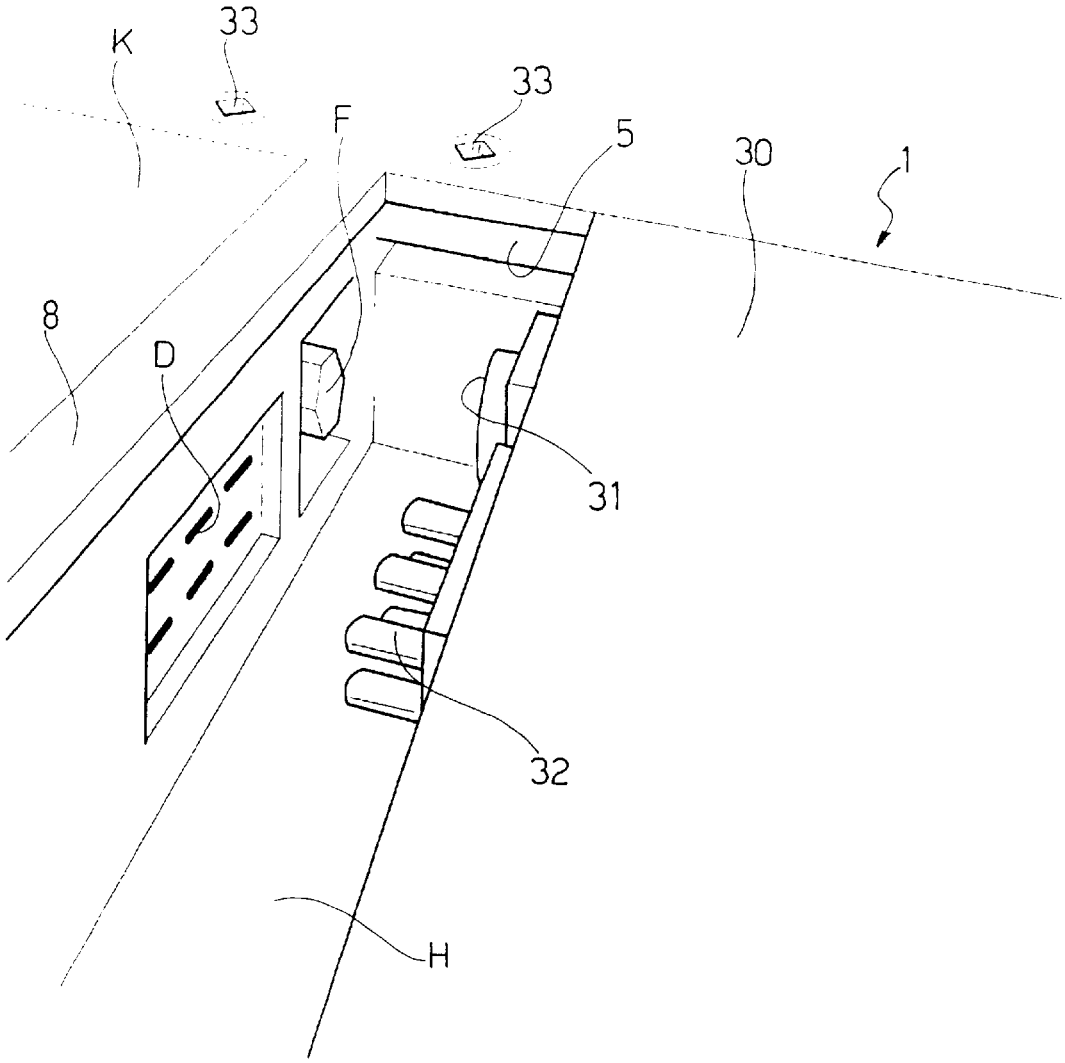
FIG. 8 depicts in an enlarged scale a detail of FIG. 7.

According to the alternative embodiment shown in FIGS. 7 and 8 the support structure can conveniently consist of a box-like housing 30, open or openable in the front, within which the platform 3 and associated operating system (disclosed in detail in the following) is pre-assembled so as to define a modular assembly. This module shall be designed to be fitted in a drawer fashion into the lateral recess H of the floor P, for instance by means of a slidable coupling between longitudinal projections provided along the sides of the housing 30 and the guides 5 of the recess H, so as to perform a quick front connection between mechanical and electrical coupling members F, D provided on the floor P and mechanical and electrical complementary coupling members 31, 32 of the housing 30, shown in better detail in FIG. 8. By virtue of such mechanical and electrical coupling members at least part of the driving system of the platform 3 can be residing on board of the vehicle, within a block diagrammatically shown as K, and may also operate a second identical platform 3 contained within a respective box-like housing 30 in turn fitted (in the same previously disclosed fashion) into a recess J opposite to the recess H on the other side of the vehicle floor. The box-like housings 30 and the block K are releasably secured to the floor P for instance by means of retaining members 33.

A mobile unit 6, substantially comprising a crossbar 7, operatively connected to a worm screw system generally designated as 34 and operated by an electric geared motor 36 (FIG. 1) arranged behind the the rear area of the supporting structure 2 (or, in the case of the arrangement shown in FIGS. 7 and 8, inside the block K), slides along the guides 5. The geared motor 36 and related worm screw mechanism 34, which can be arranged centrally as in FIG. 1 or laterally shifted as in FIGS. 7 and 8, are not illustrated in detail for the sake of simplicity in the drawings, as being generally within the skill of the practitioner.

Figure 3:
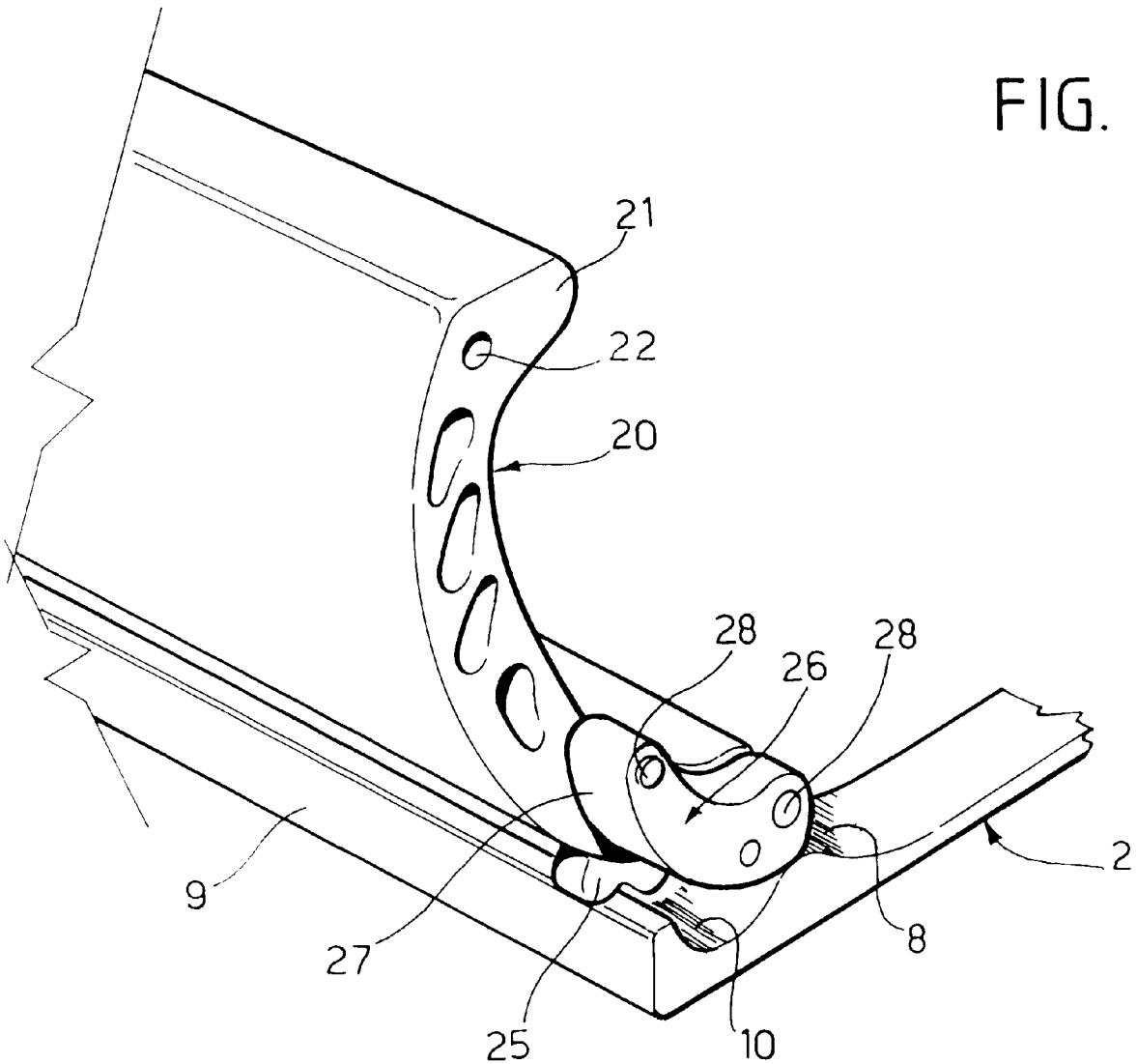
FIG. 3 shows a detail of FIG. 2 on a larger scale.

Furthermore, the front of the supporting structure comprises upwards slanted sliding surfaces 8, one of which is illustrated in greater detail in FIG. 3, conveniently presenting a rounded profile with concavity facing upwards. Immediately in front of the sliding surfaces 8, i.e. immediately near the front edge of the supporting structure 2, indicated with numeral 9, there are recesses 10, which shape is also rounded and which concavity is facing upwards, which function will be clarified below.

The platform 3 can consist of a simple platform with a front rounded edge 11 or, more conveniently, by a single frame, or, in the illustrated form of embodiment, by a double frame with a pair of driven conveyors 12. Each conveyor 12 comprises a closed ring belt 13 supported by a plurality of turning rollers 14 (FIG. 2) which turns on a pair of respective end shafts 13, 14, the first of which is turned by a geared motor 17 centrally carried by the crossbar 7 of the mobile unit 6, and the second of which is operated by the first shaft 15, via a transmission, generally indicated with numeral 18. The end shafts 13 are driven by the shaft 37 (FIG. 1) of the geared motor 17 in a way not shown in detail since generally within the skill of the practitioner.

A profiled element 20, with an arched profile, normally consisting of an extruded metallic element (e.g. made of aluminium), is articulated on the rear edge of the platform 3, indicated with numeral 19. The profile 20 is shaped as a banana, with a thicker front edge 21, which ends are provided with holes 22 for connecting, by means of respective pins 23 and arms 24, to the rear side 19 of the platform 3.

The ends of the extruded element 20 are provided with a pair of contoured stops 25, one of which is shown in detail in FIG. 3, for co-operating with the recess areas 10 next to the front edge 9 of the supporting structure 2, in the way described below.

Furthermore, near each stop 25, the profiled element 20 has a respective end element 26, which shape is arched and complementary with respect to that of the corresponding sliding surface 8 of the supporting structure 2, with which it co-operates, More in detail, each end element 26 presents a lower convex surface 27 and is formed with two lateral holes 28 for connecting to the mobile unit 6, via articulated arms diagrammatically shown as 35 in FIG. 1 (and omitted for the sake of clarity in the other figures).

The sliding surfaces 8 and the complementary surfaces 27 of the end elements 26 define reciprocally co-operating cam means for controlling, during operation, the oscillation of the platform 3 without the need of using any additional actuators or complicated mechanisms.

The operation of the ramp 1 according to this invention is described below.

In the retracted condition illustrated in FIG. 1, platform 3 is contained within the housing 4 of the supporting structure 2, underneath the floor P of the vehicle B, in parallel to the floor.

Figure 4:
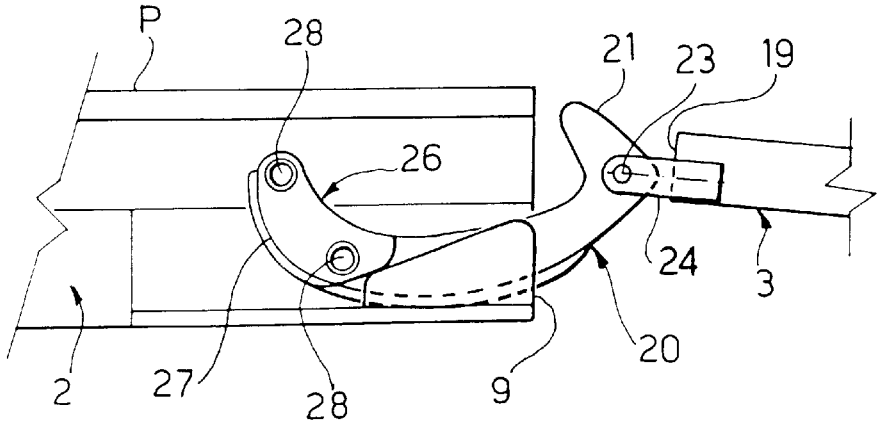
FIGS. 4, 5 and 6 are three schematic, simplified lateral elevation views showing the detail in FIG. 2 in three different operating positions.
Figure 5:
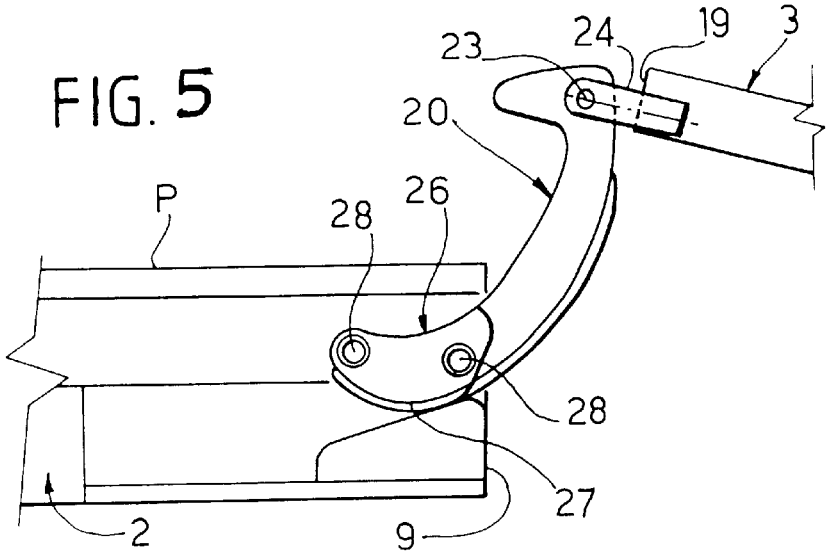

When extraction is controlled, also by means of a remote control or magnetic card system equipping the vehicle B, the electric geared motor 36 and worm screw system 34 operatively associated to the mobile unit 8 controls advancement of the latter along the guides 5 so to extract the platform 3 from the supporting structure 2. The platform 3 is kept parallel to the floor P until, during the final part of its extraction movement, the surfaces 27 of the end elements 26 come in contact with the sliding surfaces 8 of the supporting structure 2 (FIG. 4). From this contact position, the additional extraction movement of the platform 3 produces, by effect of the interaction between the surfaces 27 and 8, the raising of the rear edge 19 of the platform 3 (FIG. 5) and, consequently, causes the slanting of the latter downwards until it rests its front edge 11 on the ground G. At the end of the extraction and rocking displacement of the platform 3, the stops 25 engage the front edges of the recesses 10, thus stabily holding the platform 3 in the extracted-slanted position.

In this position, a wheelchair or children's pushchair can be easy pushed from the ground G onto the floor P, or vice-versa. In the first case, the operation of the driven conveyors 13 facilitates ascent of the wheelchair or pushchair, also if the slant angle of ramp 1 exceeds the normal gradient (8%).

The particular configuration of the stops 25 and the recesses 10 relieve the weight of the wheelchair or pushchair on the supporting structure 2, and, consequently, onto the structure of the vehicle B, naturally in addition to the ground G, through the front edge 11 of the platform 3.

Figure 6:
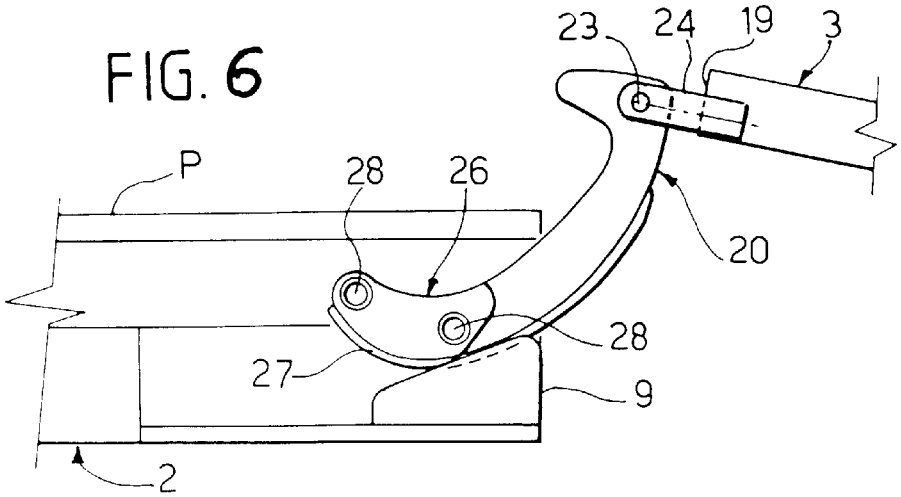

After ascent or descent of the user from the vehicle, the platform 3 can be returned to its original position. This is obtained by retracting the mobile unit 6 operated by the respective electric geared motor 36 and worm screw system 34. During the initial phase of the platform 3 displacement towards the retracted position, the stops 26 are engaged by the recesses 10, while the interaction between the cam surfaces 27 and 8 causes the downwards rotation (FIG. 6) of the end elements 26 and, consequently, of the profile 20. The rear side 29 of the platform 3 is, consequently, lowered, while said platform is re-arranged in the horizontal position for being completely retracted in the original resting position.

Naturally, numerous changes can be implemented to the construction and forms of embodiment of the invention herein envisaged, all comprised within the context of the concept characterising this invention.

What is claimed is:

1. A foldaway ramp for the access of disabled people's wheelchairs and children's pushchairs aboard vehicles (B) with a low slung floor (P) comprising:

a supporting structure (2) embedded within a recess (H) provided under said vehicle (B) floor (P), a mobile unit (6) movable mounted in said recess, a platform (3) connected to said mobile unit and displaceable between a retracted position parallel to the vehicle (B) floor (P), and an extended position, with respect to said supporting structure (2), said platform (3) having a front end (11) and a rear end (19), electric actuator control means (36) for moving said mobile unit and said platform (3) between said retracted position and said extended position, and cam means (8, 27) for controlling slant of said platform (3) during the final phase of its displacement towards the extended position from a position parallel to said floor (P) to a downwardly slanted position where the front end (11) of the platform (3) rests on the ground (G), and the return of said platform to said position in which it is parallel to the floor (P) during the initial phase of its displacement towards said retracted position, by effect respectively of raising and lowering the rear side (19) of said platform (3) operated by said cam means (8, 27), wherein said cam means comprises:

upwardly slanted sliding surfaces (8) arranged adjacent a rear edge (9) of said supporting structure (2), an elongated element having a curved cross-section articulated at opposite ends to opposite sides of said platform and extending upwardly along said rear end thereof and complementary elements (26, 27) connected to opposite ends of said elongated element and articulated to said mobile unit, said complementary elements having a curved profile complementary to said upwardly slanted sliding surfaces and disposed in sliding contact with said upwardly slanting sliding surfaces to move said platform to and from said downwardly slanting position.

2. Ramp according to claim 1, wherein said cam means also include reciprocal releasable stop means (10, 15) for stopping said platform (3) in said downwards slanted position.

3. Ramp according to claim 2, wherein said reciprocal releasable stop means comprise recesses (10) arranged near the front edge (9) of said supporting structure (2), in front of said sliding surfaces (8), and stop projections (25) near to said complementary elements (26, 27) and designed to engage said recesses (10).

4. Ramp according to claim 1, wherein said platform (3) consists of a frame carrying motor-driven endless conveyor means (13).

5. Ramp according to claim 1, wherein said supporting structure (2) consists of a box-like housing (30) within which said platform (3) is pre-assembled so as to define a modular member designed to be fitted into said recess (H) of the vehicle floor (F), quick mechanical and electrical front coupling means (F, D; 31, 32) being provided between said box-like housing (30) and said recess (H).

* * * * *